US012221844B2

(12) United States Patent
Polo Terán et al.

(10) Patent No.: US 12,221,844 B2
(45) Date of Patent: Feb. 11, 2025

(54) MILLING AND WELLBORE METAL DEBRIS RECOVERY ASSEMBLY

(71) Applicant: Saudi Arabian Oil Company, Dhahran (SA)

(72) Inventors: Juan Manuel Polo Terán, Dhahran (SA); Bandar S. Malki, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 92 days.

(21) Appl. No.: 18/092,719

(22) Filed: Jan. 3, 2023

(65) Prior Publication Data

US 2024/0218753 A1 Jul. 4, 2024

(51) Int. Cl.
*E21B 21/12* (2006.01)
*E21B 27/00* (2006.01)
*E21B 29/00* (2006.01)

(52) U.S. Cl.
CPC ..... *E21B 21/12* (2013.01); *E21B 27/005* (2013.01); *E21B 29/002* (2013.01); *E21B 29/005* (2013.01)

(58) Field of Classification Search
CPC ..... E21B 27/00; E21B 27/005; E21B 29/00; E21B 29/002; E21B 37/02
See application file for complete search history.

(56) References Cited

U.S. PATENT DOCUMENTS 2,915,127 A * 12/1959 O'Farrel ..... E21B 31/08 166/99
3,023,810 A * 3/1962 Anderson ..... E21B 27/005 166/227
5,682,950 A * 11/1997 Bjørnstad ..... E21B 31/06 166/99
8,136,587 B2 3/2012 Lynde et al.
9,062,507 B2 6/2015 Knobloch, Jr. et al.
11,255,150 B2 * 2/2022 Alarfaj ..... E21B 17/1078
(Continued)

OTHER PUBLICATIONS

Haugen et al., "Electric-Line Deployed Lightweight Intervention Technology for The Effective Removal of Barium Sulphate Scale Obstructions from Small Diameter Wellbores," SPE-184758-MS, Society of Petroleum Engineers, 2017, 15 pages.
(Continued)

*Primary Examiner* — David Carroll
(74) *Attorney, Agent, or Firm* — Fish & Richardson P.C.

(57) ABSTRACT

A milling and wellbore metal recovery assembly includes a milling assembly that can mill a casing disposed in a wellbore. A primary debris removal assembly is connected to the milling assembly and can reside uphole of the milling assembly. The primary debris removal assembly can clear debris resulting from the milling assembly milling the casing disposed in the wellbore by reverse circulating wellbore fluid in an uphole direction from an annulus formed by the wellbore and through the primary debris removal assembly. A second debris removal assembly is connected to the primary debris removal assembly, and can reside uphole of the primary debris removal assembly. The secondary debris removal assembly can clear debris resulting from the milling assembly milling the casing by circulating wellbore fluid in a downhole direction through the secondary debris removal assembly and then in the uphole direction through the annulus towards a surface of the wellbore.

18 Claims, 3 Drawing Sheets

(56) References Cited

U.S. PATENT DOCUMENTS

| | | | | |
|---|---|---|---|---|
| 2009/0126933 | A1* | 5/2009 | Telfer | E21B 27/00 166/99 |
| 2010/0288492 | A1* | 11/2010 | Blackman | E21B 27/005 166/250.01 |
| 2012/0118570 | A1* | 5/2012 | Krohn | E21B 29/005 166/55 |
| 2012/0118571 | A1* | 5/2012 | Zhou | E21B 31/08 166/99 |
| 2015/0337630 | A1 | 11/2015 | Cioanta et al. | |
| 2019/0048675 | A1 | 2/2019 | Alley et al. | |

OTHER PUBLICATIONS

Kleppan et al., "Removing Settled Barites From a Wellbore Using an Electrically Powered Well Cleanout System," SPE-179102-MS, Society of Petroleum Engineers, 2016, 14 pages.

* cited by examiner

MILLING AND WELLBORE METAL DEBRIS RECOVERY ASSEMBLY

TECHNICAL FIELD

This disclosure relates to wellbore operations, specifically wellbore milling and cleanout operations.

BACKGROUND

Hydrocarbons entrapped in subsurface reservoirs can be produced through wellbores formed through subterranean zones (e.g., a formation, a portion of a formation or multiple formations) from a surface of the Earth to the subsurface reservoirs. Wellbore tubing (e.g., casing, production tubing or similar tubing) can be installed in the wellbore to produce the hydrocarbons. Such wellbore tubing may need to be milled from time to time. For example, a casing may need to be milled so that well tools uphole of the casing can access the wellbore or the subterranean zone downhole of the casing. Wellbore milling operations result in debris, e.g., metallic pieces of the milled tubing, that needs to be removed from within the wellbore.

SUMMARY

This specification describes technologies relating to a milling and wellbore metal debris recovery assembly.

Certain aspects of the subject matter described here can be implemented as a well tool assembly. The assembly includes a tubular body that can axially and fluidically couple to a wellbore tubing, and that can be disposed within a wellbore. The tubular body and the wellbore define an annulus. The tubular body can flow wellbore fluid from a surface of the wellbore in a downhole direction. Multiple ports are formed on the assembly. When open, the multiple ports can flow the wellbore fluid from within the tubular body into the annulus. The assembly includes multiple petals on a downhole end of the assembly. The multiple petals can permit the portion of the wellbore fluid to reverse circulate in an uphole direction from the annulus through an annular tubing attached to the tubular body. The assembly includes multiple debris collectors including filter screens. The multiple debris collectors are positioned within the annular tubing in a flow path of reverse circulating wellbore fluid. The multiple debris collectors are configured to trap debris carried by the portion of the wellbore fluid reverse circulating through the tubular body.

An aspect combinable with any other aspect includes the following features. The multiple ports are a first set of ports. A second set of ports are formed on the assembly. The second set of ports can receive the reverse circulating wellbore fluid that has flowed through the multiple debris collectors and flow the reverse circulating wellbore fluid into the annulus.

An aspect combinable with any other aspect includes the following features. The multiple debris collectors include a collection chamber positioned upstream of the filter screens. The collection chamber can collect the debris that falls in the downhole direction from the filter screens.

An aspect combinable with any other aspect includes the following features. The multiple debris collectors include multiple magnets that can magnetically attract ferrous debris carried by the reverse circulating wellbore fluid.

An aspect combinable with any other aspect includes the following features. The assembly includes a retention sleeve that is installed within the tubular body. The retention sleeve covers the multiple ports when the assembly is lowered into the wellbore. The retention sleeve can axially slide to uncover and open the multiple ports.

An aspect combinable with any other aspect includes the following features. The assembly includes a ball seat positioned downhole of the multiple ports. The ball seat can receive a ball that prevents flow of the wellbore fluid in the downhole direction through the tubular body.

An aspect combinable with any other aspect includes the following features. The assembly includes shearing pins that can engage the retention sleeve and maintain the retention sleeve to cover the multiple ports prior to the ball seat receiving the ball. The shearing pins can be sheared to permit the retention sleeve to axially slide to uncover and open the multiple ports.

Certain aspects of the subject matter described here can be implemented as a method. Using a milling assembly lowered into a wellbore, a casing installed in the wellbore is milled. Milling the casing causes debris to be released into the wellbore. A primary cleaning assembly is connected to and is uphole of the milling assembly. Wellbore fluid is flowed in a downhole direction to collect the debris. The wellbore fluid is flowed through a cleaning assembly that is installed in the wellbore, and fluidically connected to and uphole of the milling assembly. A portion of the wellbore fluid is flowed out of the cleaning assembly into an annulus defined between the wellbore and the cleaning assembly. The portion of the wellbore fluid is reverse circulated through an annular tubing of the cleaning assembly. The portion of the wellbore fluid carries a portion of the debris through the annulus tubing. Multiple debris collectors are installed in the annular tubing. Using the multiple debris collectors, the portion of the debris carried through the annular tubing is captured. The wellbore fluid is reverse circulated through the cleaning assembly into the annulus to flow towards a surface of the wellbore.

An aspect combinable with any other aspect includes the following features. To flow the wellbore fluid to collect the debris in the downhole direction through the cleaning assembly, the wellbore fluid is flowed through a tubular body of the cleaning assembly. The annular tubing is attached to the tubular body.

An aspect combinable with any other aspect includes the following features. To flow the portion of the wellbore fluid out of the cleaning assembly into the annulus, multiple first ports, which are formed through the tubular body and the annular tubing are opened. The multiple first ports connect to the annulus. To open the multiple first ports, a retention sleeve covering the multiple first ports is axially slide in an axially downhole direction.

An aspect combinable with any other aspect includes the following features. To reverse circulate the portion of the wellbore fluid through the annular tubing, the portion of the wellbore fluid is flowed towards multiple petals attached to the cleaning assembly and covering an opening into the annular tubing. The portion of the wellbore fluid applies a pressure causing the multiple petals to move and expose the opening to receive the portion of the wellbore fluid.

An aspect combinable with any other aspect includes the following features. The multiple debris collectors include filter screens. To capture the portion of the debris, the debris is filtered through the filter screens.

An aspect combinable with any other aspect includes the following features. The multiple debris collectors include magnets. To capture the portion of the debris, ferrous debris carried by the portion of the wellbore fluid is magnetically retained by the magnets.

An aspect combinable with any other aspect includes the following features. The debris collectors include a debris collection chamber downhole of the filter screens and the magnets. To capture the portion of the debris, the debris collection chamber catches debris that falls in a downhole direction from the filter screens or the magnets.

An aspect combinable with any other aspect includes the following features. To flow the wellbore fluid reverse circulating through the cleaning assembly into the annulus, the reverse circulating wellbore fluid is flowed through multiple ports formed on the annular tubing connecting to the annulus.

An aspect combinable with any other aspect includes the following features. After milling the casing, and before flowing the wellbore fluid through the cleaning assembly, the wellbore fluid is flowed in an uphole direction through the annulus. Debris carried by the wellbore fluid flowing in the uphole direction is captured using string magnets installed within the cleaning assembly.

Certain aspects of the subject matter described here can be implemented as a well tool assembly. The well tool assembly includes a milling assembly that can mill a casing disposed in a wellbore. A primary debris removal assembly is connected to the milling assembly and can reside uphole of the milling assembly. The primary debris removal assembly can clear debris resulting from the milling assembly milling the casing disposed in the wellbore by reverse circulating wellbore fluid in an uphole direction from an annulus formed by the wellbore and through the primary debris removal assembly. A second debris removal assembly is connected to the primary debris removal assembly, and can reside uphole of the primary debris removal assembly. The secondary debris removal assembly can clear debris resulting from the milling assembly milling the casing by circulating wellbore fluid in a downhole direction through the secondary debris removal assembly and then in the uphole direction through the annulus towards a surface of the wellbore.

An aspect combinable with any other aspect includes the following features. The primary debris removal assembly includes a tubular body fluidically coupled to the milling assembly and the secondary debris removal assembly. The tubular body can flow the wellbore fluid from the surface of the wellbore towards the milling assembly. An annular tubing is attached to the tubular body. The annular tubing can receive the wellbore fluid reverse circulated in the uphole direction from the annulus.

An aspect combinable with any other aspect includes the following features. Multiple debris collectors are installed in the annular tubing. The multiple debris collectors can capture debris carried by the wellbore fluid reverse circulating in the uphole direction through the annular tubing.

An aspect combinable with any other aspect includes the following features. Multiple ports are formed through the tubular body and the annular tubing to the annulus. The multiple ports are configured to flow the wellbore fluid flowed in the downhole direction through the tubular body into the annulus.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
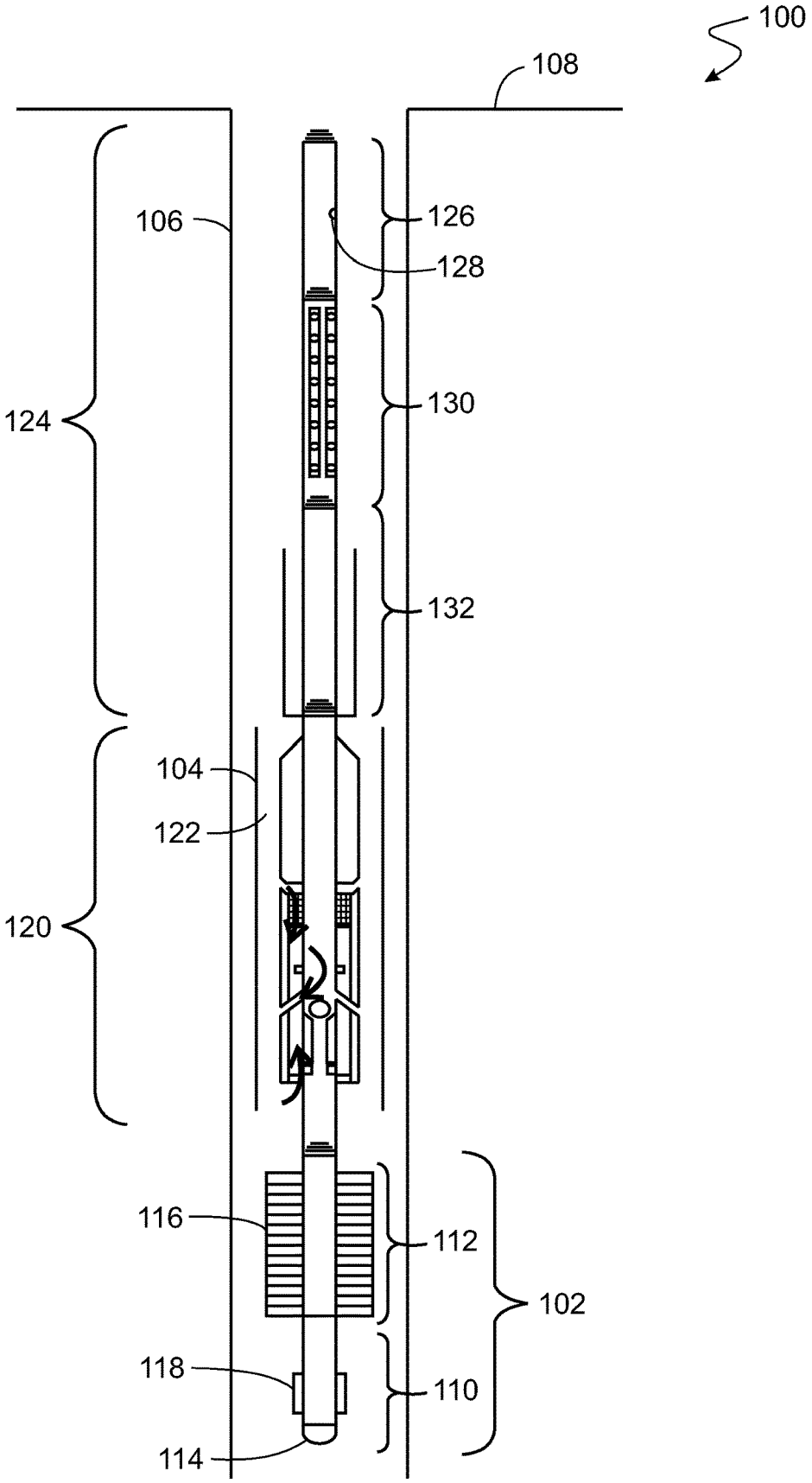
FIG. 1 is a schematic diagram of an example of a milling and wellbore metal debris recovery assembly.

Debris resulting from wellbore milling operations can be removed, for example, by flowing wellbore fluid (e.g., casing fluid sweep pills) through the wellbore. In one example, a debris recovery system that includes a tubing is lowered into the wellbore to extend from a surface of the wellbore to a downhole location where the debris lies. The wellbore fluid is flowed in a downhole direction from the surface towards the downhole location. The wellbore fluid flows out of the tubular at the downhole location and into an annulus formed by the wellbore and the tubular, and then flows in an uphole direction through the annulus towards the surface of the wellbore. With this flow, the wellbore fluid carries the debris towards the surface. The debris can include metallic, specifically ferrous debris. Such debris can be captured using magnets positioned in the flow of the wellbore fluid. Debris can also be captured using filter screens. Junk baskets can be used to prevent the debris from falling back downhole.

In some instances, debris recovery systems need to be run into the wellbore in a dedicated run, separate from and after the milling operation. That is, a milling assembly to mill the casing (or other tubing) is run into the wellbore, and subsequently removed after the milling operation has been completed. Then, the debris recovery system is lowered into the wellbore to perform the debris recovery operation. Operating the debris recovery system in a dedicated run increases a time needed to perform well operations.

This disclosure describes techniques that negate the need for dedicated debris recovery or wellbore clean out runs after milling operations. The disclosure describes a milling and wellbore debris recovery system that can collect milling or metal debris as milling operations progress, without needing to either stop the milling operation or perform a dedicated clean out run. Because the debris recovery and clean out operations can be combined with the milling operation, wellbore locations downhole of where the milling operation was performed can become accessible sooner than if the milling and clean out operations were performed separately.

This disclosure describes a debris recovery assembly in the context of milling a casing in a vertical wellbore. The techniques described in this disclosure are applicable to remove debris resulting from milling tubing other than casing as well as debris resulting from any other wellbore operations. In addition, the techniques described in this disclosure can be implemented in wellbores that are not vertical, e.g., deviated wellbores such as horizontal wellbores. In general, the debris recovery system described here can be used in any wellbore operation to eliminate the need for a dedicated clean out run. Also, debris removal described in this disclosure is implemented using flow equipment (e.g., flow pumps, flow tubes, flow reservoirs carrying wellbore fluid, filters, and the like), the details of which are well understood and therefore have not been described.

FIG. 1 is a schematic diagram of an example of a milling and wellbore metal debris recovery assembly 100. The assembly 100 includes a milling assembly 102 that can mill a casing 104 (or other tubing) disposed in a wellbore 106 extending from a surface 108 through a subterranean zone. The milling assembly 102 includes a pilot section 110 and a milling section 112. The pilot section 110 includes a pilot mill head 114 including a bullnose of a size sufficient to guide the milling assembly 102 into the casing 104. The milling section 112 includes a main milling head 116 that is centralized. The milling section 112 includes blades 116 that can be straight or spiral. The pilot section 110 can also include blades 118 to perform pilot milling. The milling assembly 102 can mill the casing 104 by a rotary action or axial oscillation or both. The milling assembly 102 can be connected to a tubing that extends to the surface 108 of the wellbore and that can be connected to equipment to provide such rotary action or axial oscillation. In addition, wellbore fluid (e.g., casing fluid or cooling fluid) can be flowed through the tubing to cool the milling assembly 102, specifically the blades, during the milling operation.

The assembly 100 includes a primary debris removal assembly 120 that is connected to the milling assembly 102. For example, when the milling assembly 102 is installed within the wellbore 106, the milling assembly 102 has a downhole end and an uphole end. Similarly, the primary debris removal assembly 120 also has an uphole end and a downhole end when installed within the wellbore 106. The downhole end of the assembly 120 can be connected (threadedly or otherwise) to the uphole end of the milling assembly 102. In this manner, the assemblies 102 and 120 can be axially coupled along a longitudinal axis of the wellbore 106, and also fluidically coupled to permit wellbore fluid to flow from the assembly 120 into the milling assembly 102. Under this arrangement, the assembly 120 resides uphole of the milling assembly 102. As described in detail with reference to FIGS. 2A and 2B, the assembly 120 can clear debris resulting from the milling assembly 102 milling the casing 104 disposed in the wellbore 106 by reverse circulating wellbore fluid in an uphole direction from an annulus 122 formed by the wellbore 106 and the assembly 120.

In some implementations, the assembly 100 also includes a secondary debris removal assembly 124 connected to the primary debris removal assembly 120. For example, when installed within the wellbore 106, the secondary assembly 124 has a downhole end and an uphole end. The downhole end of the secondary assembly 124 can be connected (threadedly or otherwise) to the uphole end of the primary assembly 120. Under this arrangement, the secondary assembly 124 resides uphole of the primary assembly 120. Wellbore fluid can flow through the secondary assembly 124 and into the primary assembly 120.

The secondary assembly 124 includes a circulating sub 126 with a circulating port 128. The circulating sub 126 can be a tubing in which the circulating port 128, e.g., an opening, is formed. Downhole of the circulating sub 126 are string magnets 130 that can magnetically attract ferrous materials, e.g., ferrous debris. Downhole of the string magnets 130 are junk subs 132, which are baskets attached to an outer surface of the secondary assembly 124. In operation, wellbore fluid (e.g., casing fluid sweep pills) are flowed from the surface 108 in a downhole direction into an interior of the secondary assembly 124, specifically through the circulating sub 128. The wellbore fluid flows through the string magnets 130, which are positioned within or on the outer surface of the secondary assembly 124, and through a tubing carrying the junk subs 132. The wellbore fluid further flows through the primary assembly 120 and exits through the downhole end of the milling assembly 102. Then, the wellbore fluid rises through the annulus 122, carrying the debris released into the wellbore 106 during the milling operation. As the wellbore fluid carrying the debris flows past the string magnets 130 of the secondary assembly 124, magnetic debris is retained by the string magnets 130. If the secondary assembly 124 includes any filter screens disposed in the annulus 122, then additional debris can be captured by the filter screens. The junk subs 132 can catch any debris that falls downhole.

In an example operation of the assembly 100, the milling assembly 102, the primary assembly 120 and the secondary assembly 124, are axially connected to each other (in that order), and run into the wellbore 106 at the top of the tubing 104 (e.g., the casing or the liner or other tubing) to be milled out. As the milling assembly 102 performs milling operations, wellbore fluid (e.g., the casing fluid sweep pills) are circulated through the primary and secondary assemblies. A portion of the debris (e.g., magnetic debris) that rises through the annulus 122 with the wellbore fluid is retained by the string magnets 130. A portion of the debris rises to the surface 108 where the debris is filtered from the wellbore fluid, and the wellbore fluid is circulated back into the assembly 100. Any debris that falls downhole in the annulus 122 is caught by the junk subs 132. After the milling operation has been performed and a portion of the debris has been collected and/or carried to the surface 108, the primary assembly 120 is activated, as described below, to further collect and/or carry debris to the surface 108.

Figure 2A:
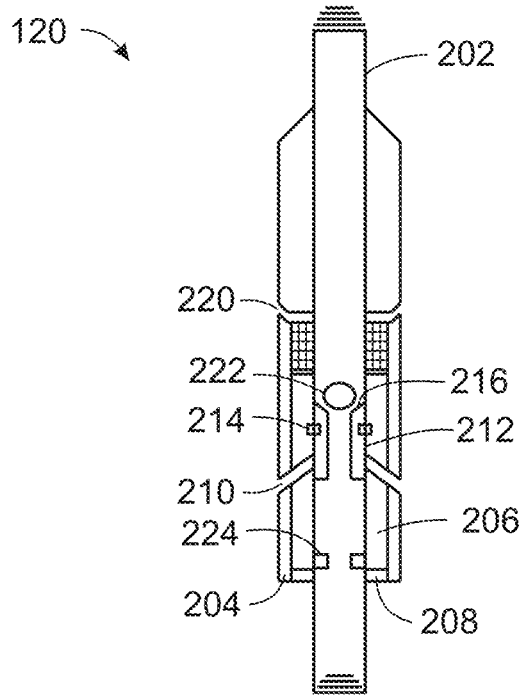
FIGS. 2A and 2B are schematic diagrams of an example of a primary cleaning assembly of the assembly of FIG. 1.
Figure 2B:
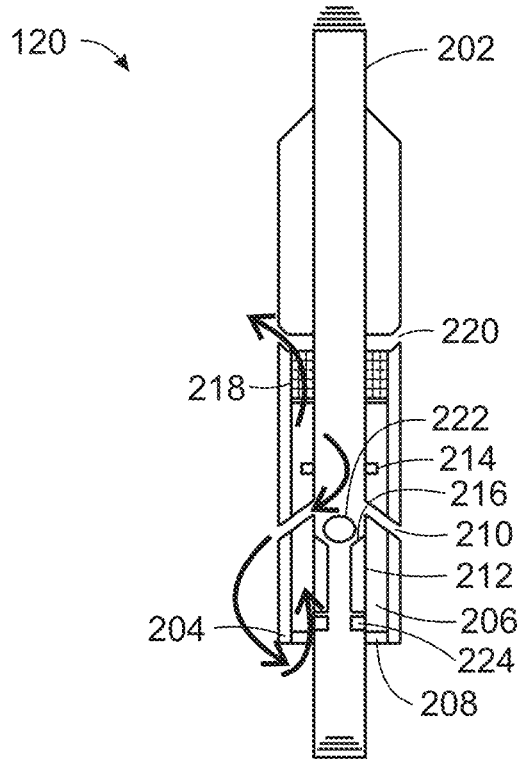

FIGS. 2A and 2B are schematic diagrams of an example of the primary cleaning assembly 120. When the primary assembly 120 is lowered into the wellbore 106 for installation, the primary assembly 120 is in a first state schematically shown in FIG. 2A. In the state schematically shown in FIG. 2A, wellbore fluid flows occurs through an internal volume of the primary assembly 120 and in a downhole direction. To operate the primary assembly 120, the primary assembly 120 is transitioned from the first state to a second state schematically shown in FIG. 2B. In the state schematically shown in FIG. 2B, wellbore fluid flows out of a side of the primary assembly 120 and then reverse circulates through an annular region in the primary assembly 120 in an uphole direction.

The primary assembly 120 includes a tubular body 202 that is configured to axially and fluidically couple to a wellbore tubing, e.g., a tubing included in the milling assembly 102 or the secondary assembly 124. The tubular body 202 defines the annulus 122 (FIG. 1) with the wellbore 106 (FIG. 1). The tubular body 202 allows wellbore fluid to flow from the surface 108 (FIG. 1) in a downhole direction. The primary assembly 120 includes annular tubing 204 attached to, e.g., coaxially positioned around, the tubular body 202. The arrangement of the tubular body 202 and the annular tubing 204 defines an internal region 206, which spans the length of the annular tubing 204. At the downhole end of the annular tubing 204, the internal region 206 is closed by multiple petals 208 (or fingers). The petals 208 can be moved between open and closed positions to permit access to the internal region 206.

Multiple ports 210 are formed on the primary assembly 120, specifically on the tubular body 202 and extending through the annular body 204. The multiple ports 210 allow fluid flow from within the tubular body 202 to outside the primary assembly 120. When the primary assembly 120 is installed within the wellbore 6 the multiple ports 210, when open, allow the wellbore fluid to flow through the side surfaces of the primary assembly 120 and into the annulus 122 (FIG. 1). When the primary assembly 120 is installed within the wellbore 106, the multiple ports 210 are closed by a retention sleeve 212 positioned over the multiple ports 210 and held in place by shearing pins 214. An uphole end of the retention sleeve 212 includes or is formed in the shape of a ball seat or ball catcher 216.

Multiple debris collectors 218 are positioned in the internal region 206 near the uphole end of the annular tubing 204, specifically uphole of (i.e., downstream of) the multiple ports 210. The debris collectors 218 include filter screens to capture debris carried by wellbore fluid flowing in an uphole direction through the internal region 206 of the annular tubing 204. The debris collectors 218 include magnetic components, e.g., extensions, projections, and the like, positioned in the internal region 206. The debris collectors 218 can also include a junk basket positioned downhole of (i.e., upstream of) the filter screens and the magnetic components to catch any debris falling downhole in the internal region 206.

The primary assembly 124 also includes multiple second ports 220 at an end of the annular tubing 210 (e.g., at an uphole end downstream of the multiple debris collectors). The ports 220 connect to the annulus 122 (FIG. 1) but not to an internal region of the tubular body 202. The ports 220 allow wellbore fluid that has flowed past the debris collectors 218 to flow into the annulus 122 (FIG. 1).

FIG. 2B schematically shows the retention sleeve 212 having axially slid in a downhole direction to open the multiple ports 210. To do so, a ball 222 is dropped through the tubular body 202 and received by the ball catcher 216 at the end of the retention sleeve 212. Pressurizing the inner region of the tubular body 202 uphole of the ball 222 seated on the ball catcher 216 causes the retention sleeve 212 to move in the downhole direction until the shearing pins 214 break causing the retention sleeve 212 to axially slide in the downhole direction. The axially sliding retention sleeve 212 is caught by a catcher/stopper 224, which can be pins or other projections extending radially inwardly from the inner surface of the tubular body 202. As described above, the multiple ports 210 open after the retention sleeve 212 has slid axially downhole. An example of an operation of the primary assembly 120 is described with reference to the flowchart shown in FIG. 3.

Figure 3:
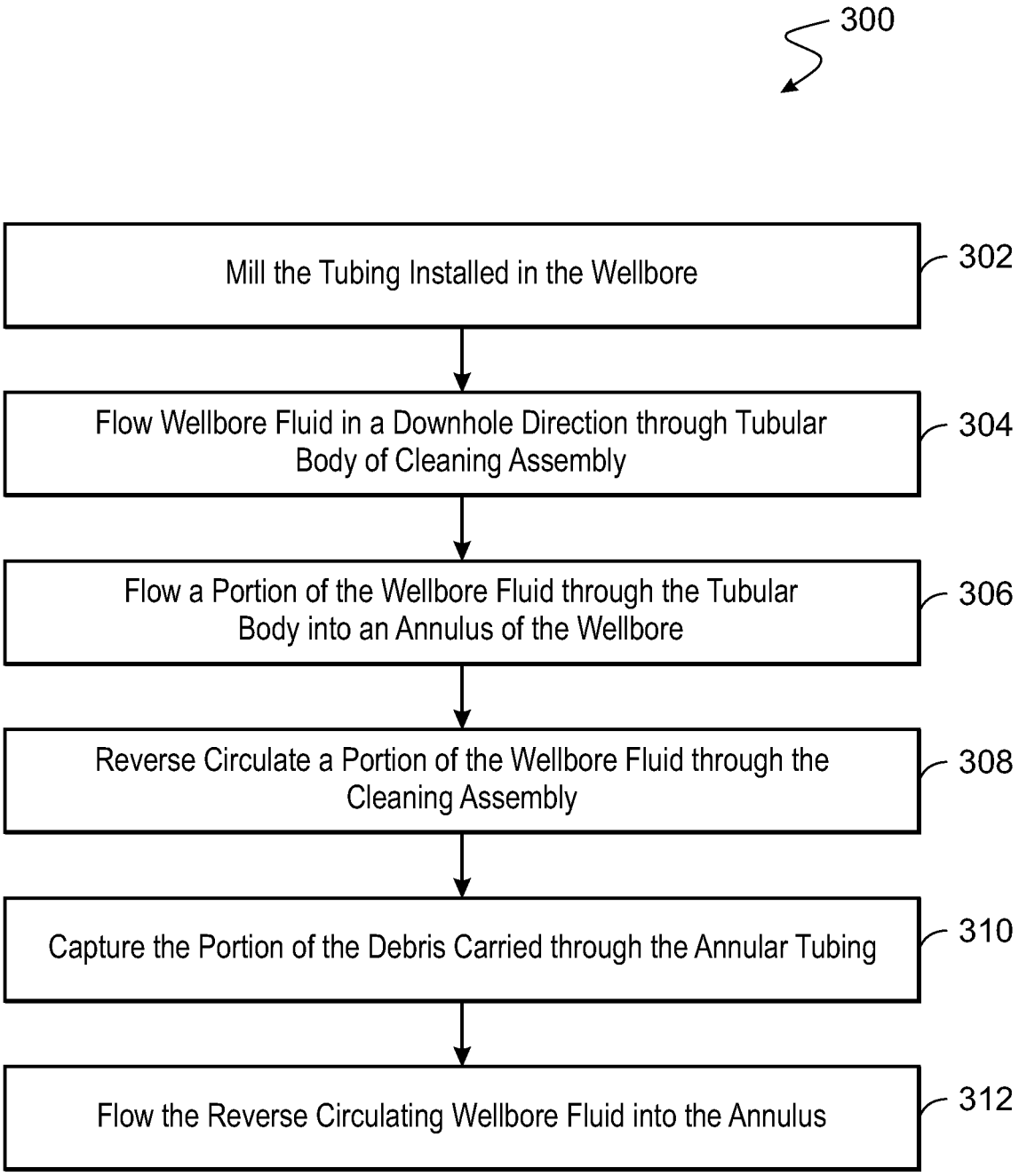
FIG. 3 is a flowchart of an example of a method of operation of the assembly of FIG. 1.

FIG. 3 is a flowchart of an example of a method 300 of operation of the assembly 120. Prior to implementation of the method 300, the assembly 100 (FIG. 1) including the milling assembly 102 and the primary debris cleaning assembly 120 is lowered into the wellbore 106, for example, to a top of the tubular 106 (e.g., casing, liner or similar wellbore tubing) that has been installed in the wellbore 106 and needs to be milled. At 302, the milling assembly mills the tubular 106. The milling operation results in debris being released into the wellbore 106, specifically, in the annulus 122 formed between the wellbore and the tubular 106. The primary assembly 124 is operated to remove the milling debris as described below.

At 304, wellbore fluid (e.g., casing fluid sweep pill) is flowed through the tubular body 202 of the primary assembly in a downhole direction. The wellbore fluid exits the downhole end of the milling assembly 102, flows into the annulus 122, and flows towards the surface 108 of the wellbore 108. The wellbore fluid carries debris in the annulus towards the surface 108.

At 306, a portion of the wellbore fluid flowing in the downhole direction through the primary assembly 124 is flowed out of the primary assembly 124 and into an annulus. To do so, the ball 222 is dropped from the surface 108 onto the ball seat 216. Downhole wellbore fluid flow is continued to pressurize the inner region of the tubular body 202. The increasing pressure causes the retention sleeve 212 to shear the shearing pins 216 and axially slide downward, thereby opening the multiple ports 210. The wellbore fluid flows through the multiple ports 210 into the annulus 122 and flows in the downhole direction towards a downhole end of the primary assembly 120.

At 308, a portion of the wellbore fluid is reverse circulated through the primary assembly 124. For example, as the wellbore fluid, which exits the multiple ports 210 and flows downhole through the annulus 122, passes the downhole end of the annular tubing 204, the wellbore fluid applies a pressure on the multiple petals 208 that cause the petals to move and permit the wellbore fluid to enter the internal region 206 between the annular tubing 204 and the tubular body 202. To reverse wellbore fluid flow direction from a downhole direction into an at least partially uphole direction, a sealing mechanism (such as a packer) can be installed downhole of the annular tubing 204 in the annulus formed by the annular tubing 204 and the wellbore. The wellbore fluid carries some of the debris in the annulus 122 into the internal region 206 and begins to flow in the uphole direction.

At 310, a portion of the debris carried into the internal region 206 is captured by the debris collectors positioned in the internal region 216 near an uphole end of the annular tubing 204. As described earlier, the debris can be captured by filter screens or magnetically retained by magnetic extensions positioned in the internal region 206.

At 312, the reverse circulating wellbore fluid is flowed from within the primary assembly into the annulus 122. For example, after flowing past the debris collectors, the wellbore fluid exits the internal region 206 through the ports 220 that fluidically connect the internal region 206 to the annulus 122, while not connecting the internal region 206 to the inner region of the tubular body 202. In addition, the ports 210 are isolated from the internal region 206 such that the wellbore fluid reverse circulating through the internal region 206 does not flow into the flow pathway of the ports 210.

In some implementations, the secondary assembly 124 can also be fluidically coupled to the primary assembly 120, as described earlier. In such implementations, an initial debris cleanup operation can be performed using the secondary assembly 124. Then, the primary assembly 120 can be activated to perform additional wellbore cleanup. The cleanup operations, using both assemblies or just the primary assembly 120, can be performed while the milling operations are being performed or without needing to first remove the milling assembly 102 from within the wellbore 102. Consequently, all the assemblies can be lowered into the wellbore together to perform the milling and wellbore cleanup operations (either in parallel or in sequence, i.e., milling, then cleanup) in the same run. After the milling and cleanup operations have been completed, all the assemblies can be removed, thereby negating a second and separate run in for the cleanup operation. After the cleaning assembly (or assemblies) have been raised to the surface 108, the debris can be removed, and the assemblies prepared for re-use.

Thus, particular implementations of the subject matter have been described. Other implementations are within the scope of the following claims.

The invention claimed is:

1. A well tool assembly comprising:

a tubular body configured to axially and fluidically couple to a wellbore tubing and to be disposed within a wellbore, the tubular body and the wellbore defining an annulus, the tubular body configured to flow wellbore fluid from a surface of the wellbore in a downhole direction;

a plurality of first ports formed on the assembly, the plurality of first ports configured, when open, to flow the wellbore fluid from within the tubular body into the annulus;

a plurality of petals on a downhole end of the assembly, the plurality of petals configured to permit the portion of the wellbore fluid to reverse circulate in an uphole direction from the annulus through an annular tubing attached to the tubular body, wherein the plurality of petals are downhole of the plurality of first ports;

a plurality of debris collectors comprising filter screens, the plurality of debris collectors positioned within the annular tubing in a flow path of reverse circulating wellbore fluid, the plurality of debris collectors configured to trap debris carried by the portion of the wellbore fluid reverse circulating through the tubular body; and a plurality of second ports formed on the assembly, the plurality of second ports configured to receive the reverse circulating wellbore fluid that has flowed through the plurality of debris collectors and to flow the reverse circulating wellbore fluid into the annulus, wherein the plurality of second ports are uphole of the plurality of first ports.

2. The assembly of claim 1, wherein the plurality of debris collectors comprise a collection chamber positioned upstream of the filter screens, the collection chamber configured to collect the debris that falls in the downhole direction from the filter screens.

3. The assembly of claim 2, wherein the plurality of debris collectors comprises a plurality of magnets configured to magnetically attract ferrous debris carried by the reverse circulating wellbore fluid.

4. The assembly of claim 1, further comprising a retention sleeve installed within the tubular body, wherein the retention sleeve covers the plurality of ports when the assembly is lowered into the wellbore, the retention sleeve configured to axially slide to uncover and open the plurality of ports.

5. The assembly of claim 4, further comprising a ball seat positioned downhole of the plurality of ports, the ball seat configured to receive a ball that prevents flow of the wellbore fluid in the downhole direction through the tubular body.

6. The assembly of claim 5, further comprising shearing pins configured to engage the retention sleeve and maintain the retention sleeve to cover the plurality of ports prior to the ball seat receiving the ball, the shearing pins configured to be sheared to permit the retention sleeve to axially slide to uncover and open the plurality of ports.

7. A method comprising:

milling, by a milling assembly lowered into a wellbore, casing installed in the wellbore, wherein milling the casing causes debris to be released into the wellbore, wherein a cleaning assembly is connected to and is uphole of the milling assembly;

flowing in a downhole direction, through a cleaning assembly installed in the wellbore and fluidically connected to and uphole of the milling assembly, wellbore fluid to collect the debris;

flowing a portion of the wellbore fluid out of the cleaning assembly into an annulus defined between the wellbore and the cleaning assembly by opening a plurality of first ports formed through the tubular body and the annular tubing and connecting to the annulus;

reverse circulating the portion of the wellbore fluid through an annular tubing of the cleaning assembly by flowing the portion of the wellbore fluid towards a plurality of petals attached to the cleaning assembly, the portion of the wellbore fluid carrying a portion of the debris through the annular tubing, a plurality of debris collectors installed in the annular tubing, wherein the plurality of petals are downhole of the plurality of first ports;

capturing, using the plurality of debris collectors, the portion of the debris carried through the annular tubing; and flowing the wellbore fluid reverse circulating through the cleaning assembly through a plurality of second ports formed on the annular tubing connecting to the annulus and into the annulus to flow towards a surface of the wellbore, wherein the plurality of first ports are uphole of the plurality of second ports.

8. The method of claim 7, wherein flowing the wellbore fluid to collect the debris in the downhole direction through the cleaning assembly comprises flowing the wellbore fluid through a tubular body of the cleaning assembly, wherein the annular tubing is attached to the tubular body.

9. The method of claim 8, wherein opening the plurality of first ports comprises axially sliding a retention sleeve covering the plurality of first ports in an axially downhole direction.

10. The method of claim 7, wherein reverse circulating the portion of the wellbore fluid through the annular tubing comprises flowing the portion of the wellbore fluid towards a plurality of petals attached to the cleaning assembly and covering an opening into the annular tubing, the portion of the wellbore fluid applying a pressure causing the plurality of petals to move and expose the opening to receive the portion of the wellbore fluid.

11. The method of claim 7, wherein the plurality of debris collectors comprise filter screens, wherein capturing the portion of the debris comprises filtering the debris through the filter screens.

12. The method of claim 11, wherein the plurality of debris collectors comprise magnets, wherein capturing the portion of the debris comprises magnetically retaining ferrous debris carried by the portion of the wellbore fluid.

13. The method of claim 12, wherein the plurality of debris collectors comprises a debris collection chamber downhole of the filter screens and the magnets, wherein capturing the portion of the debris comprises catching, by the debris collection chamber, debris that falls in a downhole direction from the filter screens or the magnets.

14. The method of claim 7, further comprising, after milling the casing, and before flowing the wellbore fluid through the cleaning assembly:

flowing the wellbore fluid in an uphole direction through the annulus; and capturing debris carried by the wellbore fluid flowing in the uphole direction using string magnets installed within the cleaning assembly.

15. A well tool assembly comprising:

a milling assembly configured to mill a casing disposed in a wellbore;

a primary debris removal assembly connected to the milling assembly, the primary debris removal assembly configured to reside uphole of the milling assembly, the primary debris removal assembly configured to clear debris resulting from the milling assembly milling the casing disposed in the wellbore by reverse circulating wellbore fluid in an uphole direction from an annulus formed by the wellbore and through the primary debris removal assembly; and a secondary debris removal assembly connected to the primary debris removal assembly, the secondary debris removal assembly configured to reside uphole of the primary debris removal assembly, the secondary debris removal assembly configured to clear debris resulting from the milling assembly milling the casing by circulating wellbore fluid in a downhole direction through the secondary debris removal assembly and then in the uphole direction through the annulus towards a surface of the wellbore.

16. The assembly of claim 15, wherein the primary debris removal assembly comprises:

a tubular body fluidically coupled to the milling assembly and the secondary debris removal system, the tubular body configured to flow the wellbore fluid from the surface of the wellbore towards the milling assembly; and an annular tubing attached to the tubular body, the annular tubing configured to receive the wellbore fluid reverse circulated in the uphole direction from the annulus.

17. The assembly of claim 16, further comprising a plurality of debris collectors installed in the annular tubing, the plurality of debris collectors configured to capture debris carried by the wellbore fluid reverse circulating in the uphole direction through the annular tubing.

18. The assembly of claim 17, further comprising a plurality of ports formed through the tubular body and the annular tubing to the annulus, the plurality of ports configured to flow the wellbore fluid flowed in the downhole direction through the tubular body into the annulus.

* * * * *